US010947717B2

(12) United States Patent
Di Marino

(10) Patent No.: US 10,947,717 B2
(45) Date of Patent: Mar. 16, 2021

(54) SYSTEM FOR FIXING TO THE GROUND WALLS OF BUILDINGS

(71) Applicant: Luigi Di Marino, Fara Filiorum Petri (IT)

(72) Inventor: Luigi Di Marino, Fara Filiorum Petri (IT)

( * ) Notice: Subject to any disclaimer, the term of this patent is extended or adjusted under 35 U.S.C. 154(b) by 0 days.

(21) Appl. No.: 16/466,249

(22) PCT Filed: Dec. 5, 2017

(86) PCT No.: PCT/IB2017/057632
§ 371 (c)(1),
(2) Date: Jun. 3, 2019

(87) PCT Pub. No.: WO2018/104847
PCT Pub. Date: Jun. 14, 2018

(65) Prior Publication Data

US 2020/0071924 A1 Mar. 5, 2020

(30) Foreign Application Priority Data

Dec. 6, 2016 (IT) ..... 102016000123688

(51) Int. Cl.

| | |
|---|---|
| ***E04B 1/10*** | (2006.01) |
| ***E04B 1/28*** | (2006.01) |
| ***E04B 1/18*** | (2006.01) |
| ***E04C 3/28*** | (2006.01) |
| ***E04C 3/29*** | (2006.01) |

(52) U.S. Cl.
CPC ..... *E04B 1/28* (2013.01); *E04B 1/185* (2013.01); *E04C 3/28* (2013.01); *E04C 3/29* (2013.01)

(58) Field of Classification Search
CPC . E04B 1/167; E04B 2/721; E04B 1/40; E04B 1/08; E04B 1/10; E04B 2/82; E04B 2001/2463; E04B 2001/405
See application file for complete search history.

(56) References Cited

U.S. PATENT DOCUMENTS 1,064,580 A * 6/1913 Wheeler ..... E04B 1/08 52/262
3,885,361 A * 5/1975 De Schutter ..... E04B 2/78 52/126.4

(Continued)

FOREIGN PATENT DOCUMENTS

CN 201722789 1/2011
CN 204311564 5/2015

(Continued)

*Primary Examiner* — Gisele D Ford
(74) *Attorney, Agent, or Firm* — Forge IP, PLLC

(57) ABSTRACT

System for fixing to the ground walls of a building includes a plurality of supporting elements interposed between a concrete foundation of the building and the walls, connecting elements for connecting at least two supporting elements that are aligned on one another, adjusting elements for adjusting a distance of the supporting elements from the foundation and for correcting a possible tilt of the supporting elements with respect to a horizontal reference plane, anchoring elements for anchoring the supporting elements to the foundation, the supporting elements being made of plastics.

8 Claims, 6 Drawing Sheets

(56) References Cited

U.S. PATENT DOCUMENTS

| | | | | |
|---|---|---|---|---|
| 6,000,181 | A * | 12/1999 | Wheeler | E04B 2/7457 52/241 |
| 7,716,887 | B2 * | 5/2010 | Fouch | E04B 1/26 52/274 |
| 2002/0043040 | A1 * | 4/2002 | Cherry | E04B 2/82 52/702 |
| 2002/0046521 | A1 | 4/2002 | Steinacker, Sr. | |
| 2004/0096266 | A1 * | 5/2004 | Birnbaum | E04B 1/2403 403/187 |
| 2009/0223147 | A1 | 9/2009 | Spignesi | |
| 2013/0212965 | A1 | 8/2013 | Martigli | |
| 2015/0052829 | A1 * | 2/2015 | Babikian | E04B 2/7422 52/126.4 |
| 2015/0284948 | A1 | 10/2015 | Pozza et al. | |
| 2017/0254073 | A1 * | 9/2017 | Gallina | E04B 2/96 |
| 2019/0136568 | A1 * | 5/2019 | Karakas | E04C 5/06 |
| 2019/0203494 | A1 * | 7/2019 | West | E04B 1/40 |
| 2019/0242129 | A1 * | 8/2019 | LeBlang | E04B 2/763 |

FOREIGN PATENT DOCUMENTS

| | | |
|---|---|---|
| GB | 618030 | 2/1949 |
| JP | H04258415 A | 9/1992 |

* cited by examiner

SYSTEM FOR FIXING TO THE GROUND WALLS OF BUILDINGS

FIELD OF THE INVENTION

The present invention relates to a system for fixing to the ground walls of buildings with so-called raft foundations, in particular light buildings, such as, for example, buildings with wooden walls, or another material with a low specific weight.

BACKGROUND OF THE INVENTION

The present invention is nevertheless also applicable to buildings with masonry walls.

The light buildings, in particular with wooden walls, generally comprise a foundation, a so-called raft foundation, made with a cast of reinforced concrete substantially having the shape of a plate, on which supporting elements are fixed, which are also known as ground beams, i.e. elements with a longitudinal extent that form a base to which the walls of the building are fixed.

The ground beams can be made of wood, but, in this case, have the drawback that, being in direct contact with the raft foundation, they are exposed to humidity and rainwater, in addition to possible infiltrations of water coming from inside the building, as can occur, for example, in the case of floods inside the building.

Wooden ground beams exposed to humidity or water can rot and transmit humidity or water infiltrations to the walls of the building causing the walls to deteriorate and the stability of the building to be compromised.

Recently, ground beams have been used that are made of concrete or metal that insulate the walls of the building from the raft foundation, protecting the walls from the infiltrations of humidity and/or water and protecting the walls from deterioration.

Making ground beams of cast concrete does, however, have significant difficulties of manufacture and dimensional tolerances that are such as to make the assembly of the structure of the building above difficult, in particular the walls.

The metal beams enable the walls to be assembled easily and precisely, but are significantly expensive and can significantly affect the cost of the building.

SUMMARY OF THE INVENTION

The object of the present invention is to provide a system for fixing to the ground walls of buildings, in particular walls of light buildings, that does not have the aforesaid drawbacks.

Another object of the present invention is to provide a system for fixing to the ground walls of buildings, in particular light buildings, which permits precision assembly of the ground beams and of the walls, also in the presence of irregularities in the surface of the raft foundation.

A further object of the present invention is to provide a system for fixing to the ground walls of buildings, in particular light buildings, that effectively insulates the walls from humidity and/or water infiltrations.

The aforesaid objects are achieved with a system for fixing to the ground walls of buildings according to claim 1.

Owing to the invention, it is possible to fix with precision the ground beams to the raft foundation of the building in a perfectly horizontal position. It is further possible to fix the ground beams such that they are all at the same level.

Owing to the invention, the walls of the building can be assembled in such a manner that there are no misalignments, either horizontally, or vertically between adjacent walls.

Lastly, owing to the invention, the walls of the building are insulated from the raft foundation and are not subject to infiltrations of water or humidity coming from said foundation.

BRIEF DESCRIPTION OF THE INVENTION

Further features and advantages of the invention will become clearer from the following description, which is provided merely by way of non-limiting example, with reference to the attached drawings, in which.

DETAILED DESCRIPTION OF THE INVENTION

Figure 1:
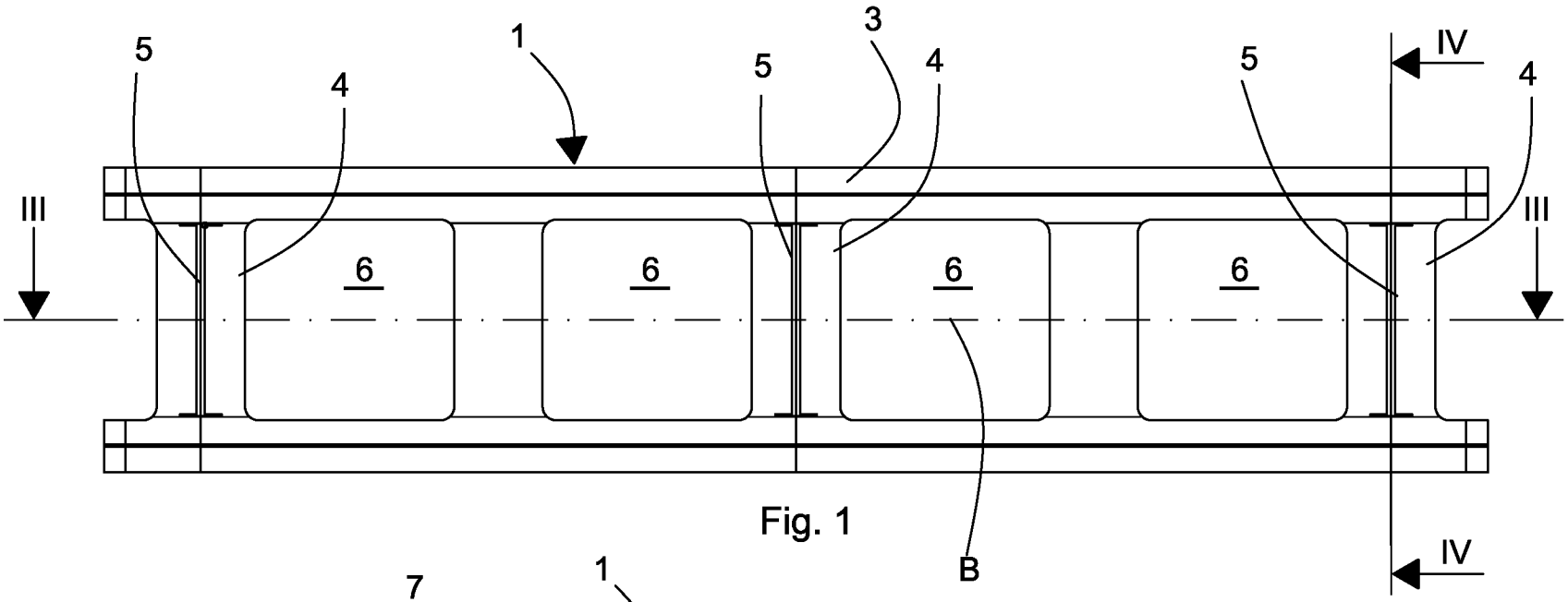
FIG. 1 is a top view of a support element, or ground beam, of the fixing system according to the invention.
Figure 2:
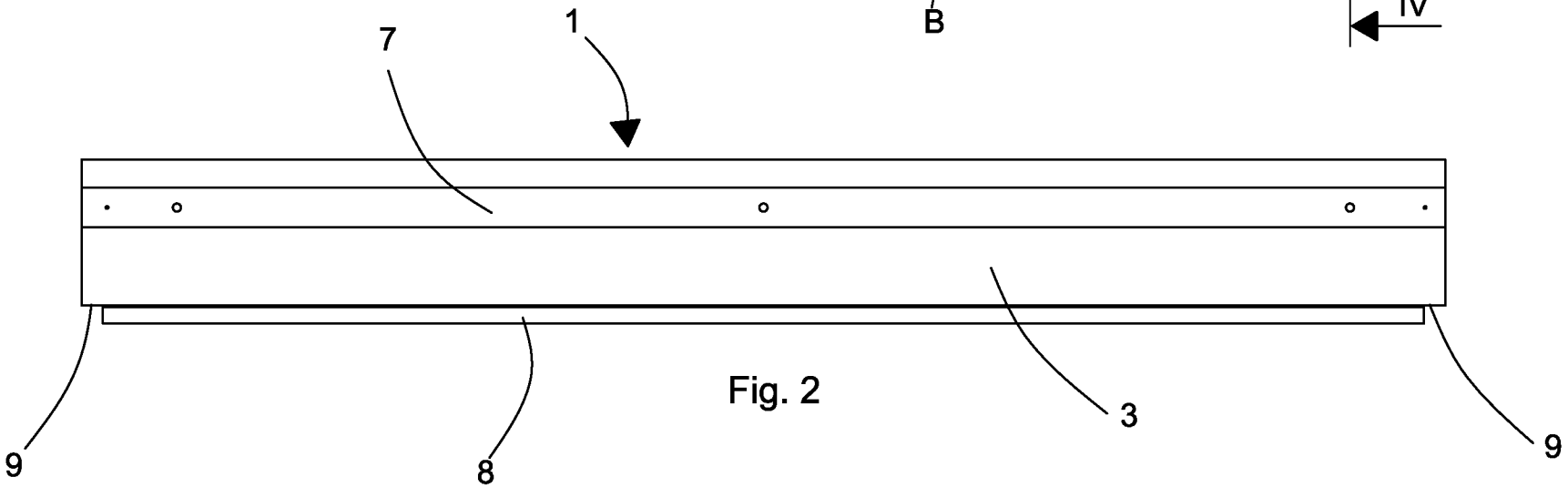
FIG. 2 is an elevation view of the ground beam of FIG. 1.
Figure 3:
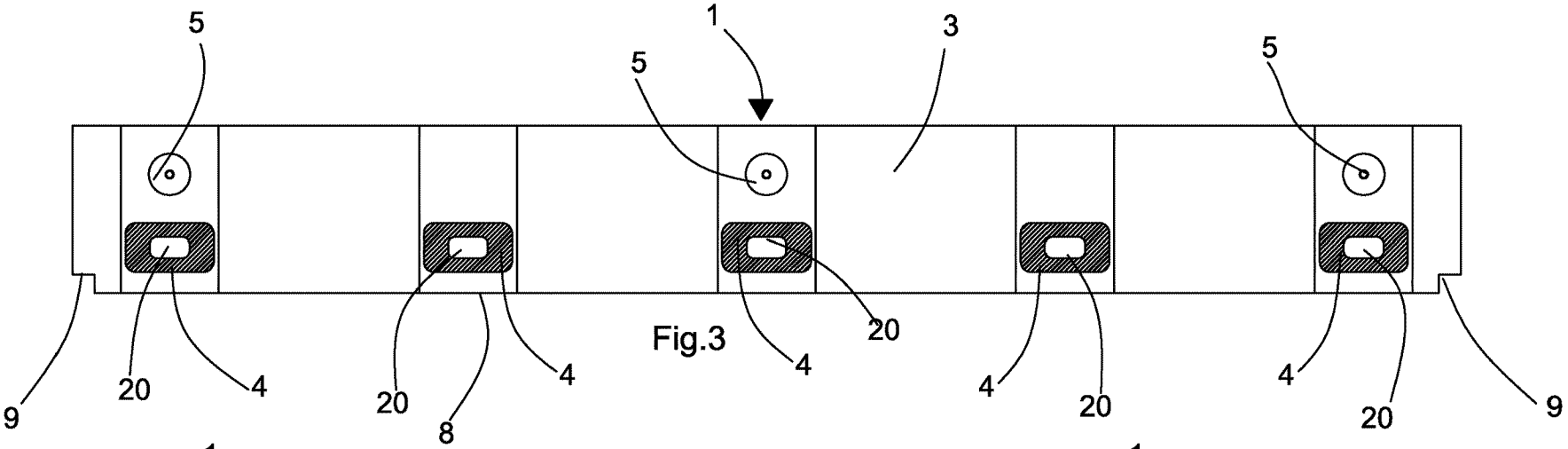
FIG. 3 is a longitudinal section of the ground beam of FIG. 1, along the line in FIG. 1.
Figure 5:
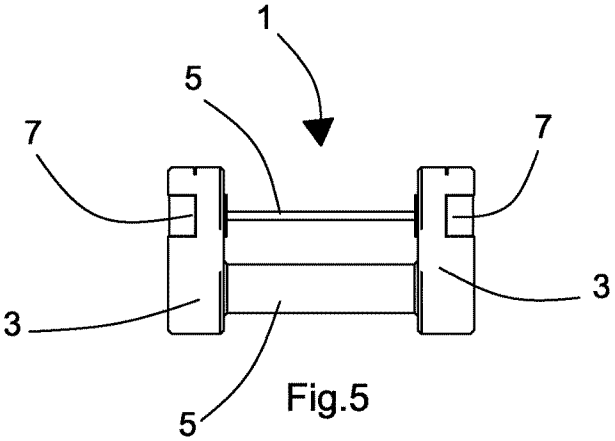
FIG. 5 is a frontal view of the ground beam of FIG. 1.
Figure 4:
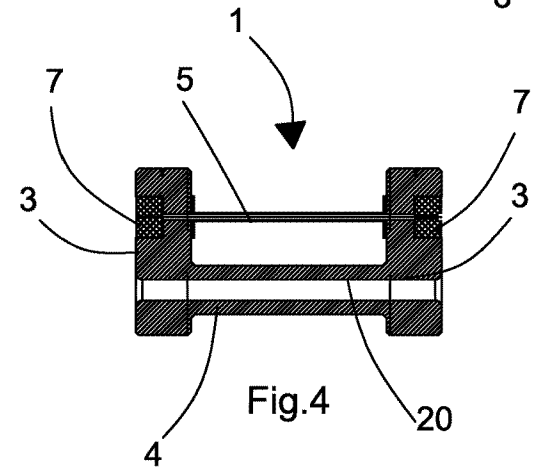
FIG. 4 is a cross section of the ground beam of FIG. 1, along the line IV-IV in FIG. 1.
Figures 6, 7, 8, 9:
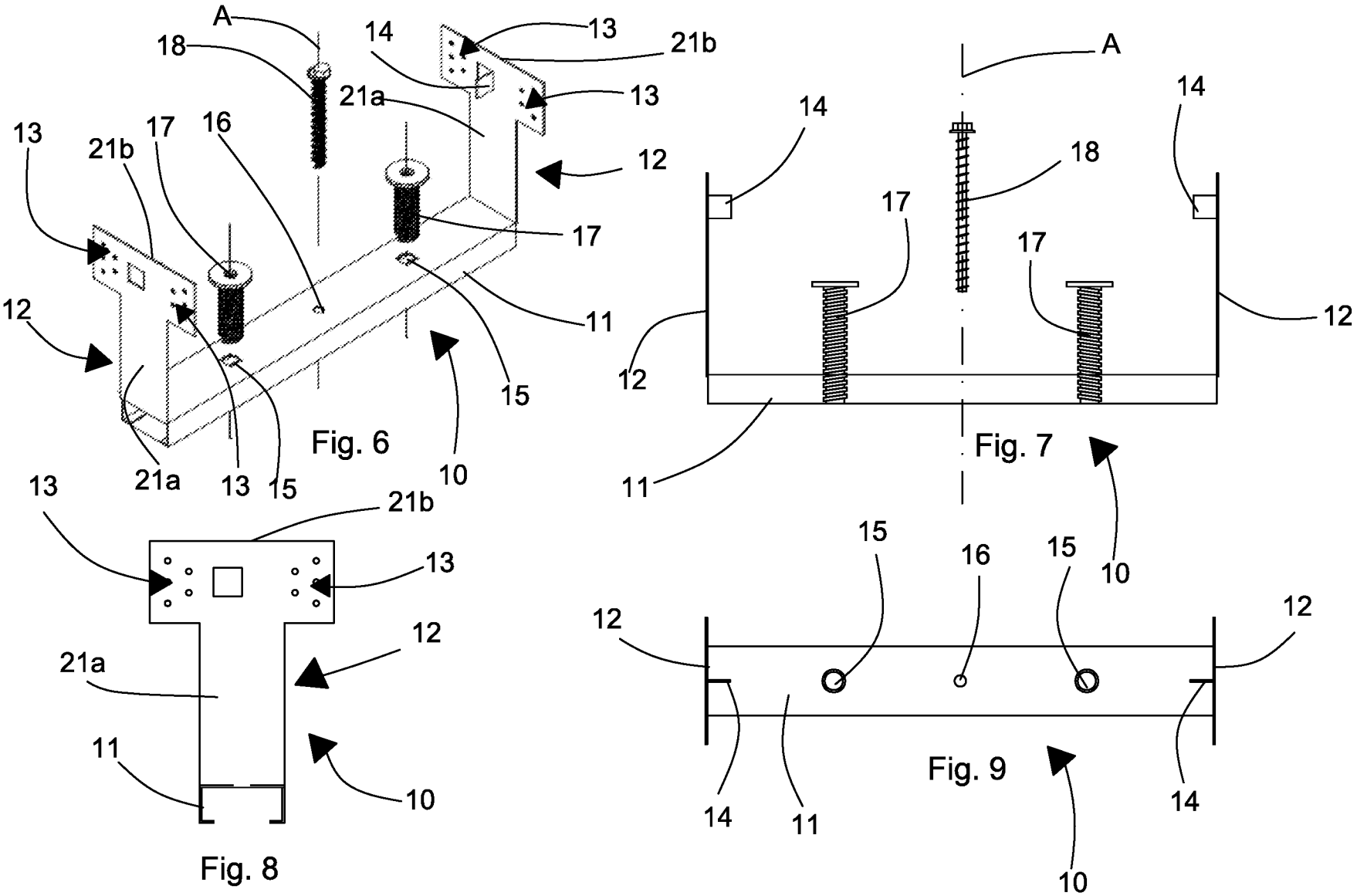
FIG. 6 is a perspective view of a fixing element by means of which adjacent ground beams are fixed together.
FIG. 7 is a raised view of the fixing element of FIG. 6.
FIG. 8 is a side view of the fixing element of FIG. 6.
FIG. 9 is a top view of the fixing element of FIG. 6.

In FIGS. 1 to 5 a support element 1 is illustrated, which is called herein after as a ground beam, made of plastics, for example moulded or extruded polystyrene, and intended to be fixed to the reinforced concrete raft foundation 2 of a building and to constitute a base onto which a wall 28 (FIG. 17) of a building (which is not illustrated) is fixed.

The ground beam 1 is part of the system according to the invention for fixing to the ground the walls 28 of the building.

The ground beam 1 made of moulded or extruded plastics is very light and thus easily transportable and manipulatable during implementation. Further, the ground beam 1 has a small cost that contributes to reduce the total cost of a building in which ground beams 1 are used to support the walls 28 of the building.

The ground beam 1 has a prevalent extent in a direction parallel to a longitudinal axis B and comprises a pair of sides 3, provided with reinforcing longitudinal inserts 7, for example made of wood. The sides 3 are interconnected by a plurality of crosspieces 4, in which through ventilation holes 20 can be made (FIG. 13), the function of which will be explained in greater detail below. The sides 3 extend perpendicularly to the raft foundation 2 when the ground beam 1 is fixed to the raft foundation 2 whereas the crosspieces 4 may be perpendicular to the sides 3.

A plurality of spacers 5 is provided, for maintaining constant the space between the sides 3 along the entire length of the ground beam 1.

On a bottom of the ground beam 1, between the sides 3 and the crosspieces 4, openings 6 are defined, the function of which will be explained below.

A lower part 8 of each side 3 has a length, in a direction parallel to the longitudinal axis B, lower than the length of the side 3 in the same direction, such that a step 9 is defined, between said lower part 8 and the rest of the side 3, at opposite ends of the sides 3 that are perpendicular to said longitudinal axis B.

In FIGS. 6 to 9, a connecting element 10 is illustrated that is used to connect together two adjacent ground beams 1.

The connecting element 10 comprises an elongated body 11, consisting, for example, of a metal section bar, for example C-shaped, it being nevertheless possible to use other forms of section bars, for example a box section bar. The body 11 has a height that is substantially the same as a height of the step 9 and a length the same as a width of the ground beam 1 in a direction perpendicular to the longitudinal axis B.

At opposite ends of the body 11 respective uprights 12 are provided, that comprise a first part 21*a* and a second part 21*b* arranged in a T shape and are arranged for being fixed to the sides 3 of two adjacent ground beams 1 to be connected. The uprights 12 extend perpendicularly to the body 11. In the second part 21*b* of each upright 12, at opposite end zones of said second part 21*b*, a respective group of holes 13 is provided into which fixing elements 22 can be inserted by means of which the connecting element 10 can be fixed to the ground beams 1 to be connected. Each upright 12 thus has a first group of holes 13 at a first end zone of the second part 21*b* and a second group of holes 13 at a second end zone opposite said first end zone. The fixing elements 22 can consist of nails, or screws.

Each second part 21*b* is provided with an abutting element 14, for example in the form of a tab, that is used to position the connecting element 11 correctly with respect to the ground beams 1 to be connected, as will be explained in greater detail below. The abutting element 14 can be obtained by punching.

The body 11 is provided with a pair of further holes 15, arranged in a symmetrical position with respect to a vertical central axis A of the body 11, and with yet a further hole 16 arranged at the central axis A. The term "vertical" means an axis that is parallel to the direction of the force of gravity.

The further holes 15 are intended for housing respective adjusting elements 17 that are used for adjusting a distance of the body 11 from the surface of the raft foundation 2 and correcting possible tilts of the body 11, so as to position the body 11 exactly horizontal. The adjusting elements 17 can consist of adjusting screws, in which case the further holes 15 are threaded.

The still further hole 16 is intended for housing an anchoring element 18, which is used to fix the connecting element 10 to the raft foundation 2 of the building.

The anchoring element 18 can consist of a self-tapping screw for concrete.

Figure 10:
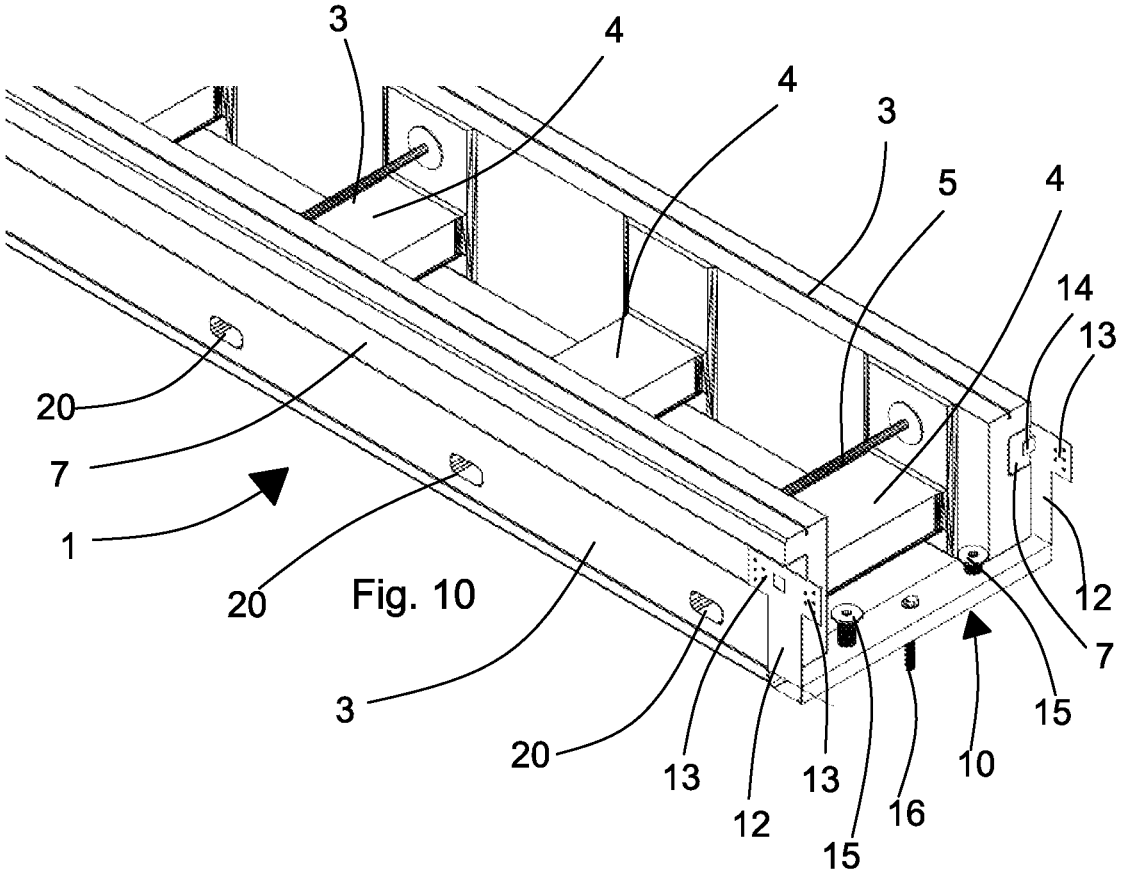
FIGS. 10 and 11 illustrate the manner in which two adjacent ground beams are fixed together.
Figure 11:
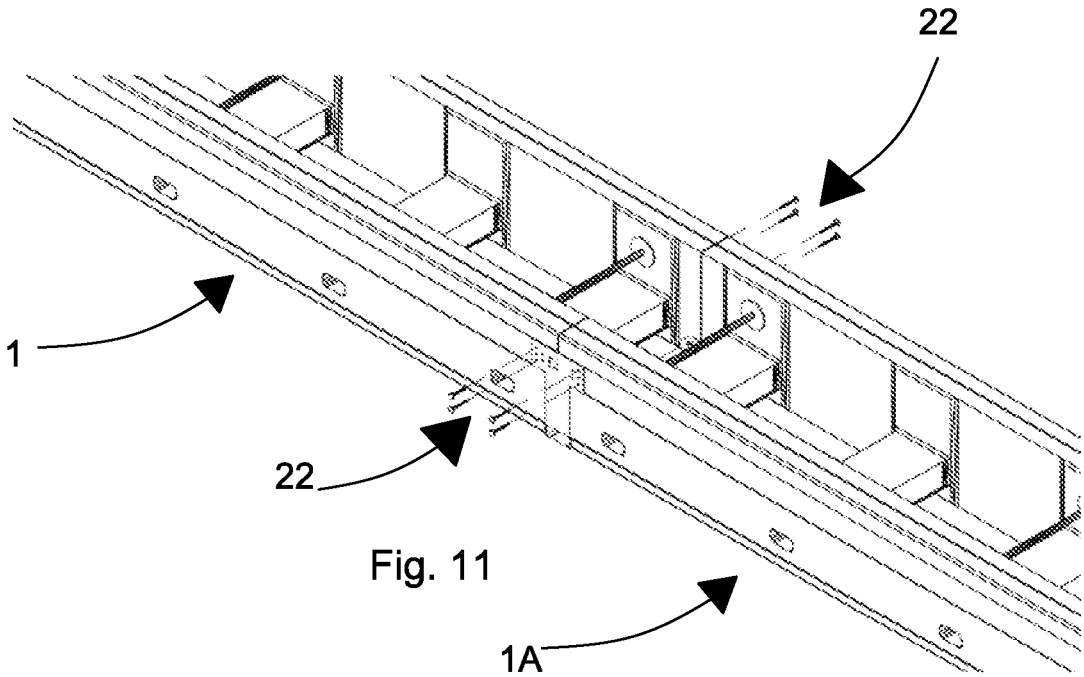

In FIGS. 10 and 11 it is illustrated how two adjacent ground beams 1, 1A are connected together using the connecting elements 10.

In FIG. 10 a first step is illustrated of the connecting procedure in which a connecting element 10 is placed at an end of a first ground beam 1, such that the body 11 is inserted into the step 9, until the abutting elements 14 abut on the ground beam 1, at the reinforcing elements 7, such that a first group of holes 13 of each upright 12 is situated at a respective reinforcing element 7 of the first ground beam 1. Subsequently, a second ground beam 1A is brought up to the first ground beam 1 until an end of the beam 1A abuts on the end of the ground beam 1 on which the connecting element 10 rests, so that a second group of holes 13 of each upright 12 is situated at a respective reinforcing element 7 of the second ground beam 1A. Lastly, the connecting element 10 is fixed to the ground beams 1 and 1A by the fixing elements 22 that are inserted into the reinforcing element 7 of the first ground beam 1 through the first group of holes and in the reinforcing element 7 of the second ground beam 1A through the second group of holes 13.

Owing to the connecting element 10, it is possible to fix rapidly together and with precision two adjacent ground beams 1, and, as will be explained in greater detail below, adjust the distance thereof from the surface of the foundation 2 and correct possible tilts with respect to a horizontal reference plane, so as to arrange the ground beams 1 all parallel to said horizontal reference plane, so that there are no misalignments, either horizontally or vertically between adjacent ground beams 1, and thus between the walls 28 supported by the ground beams 1.

In FIGS. 12 to 18 the steps of making a wall of a building with the system according to the invention are illustrated.

Figure 12:
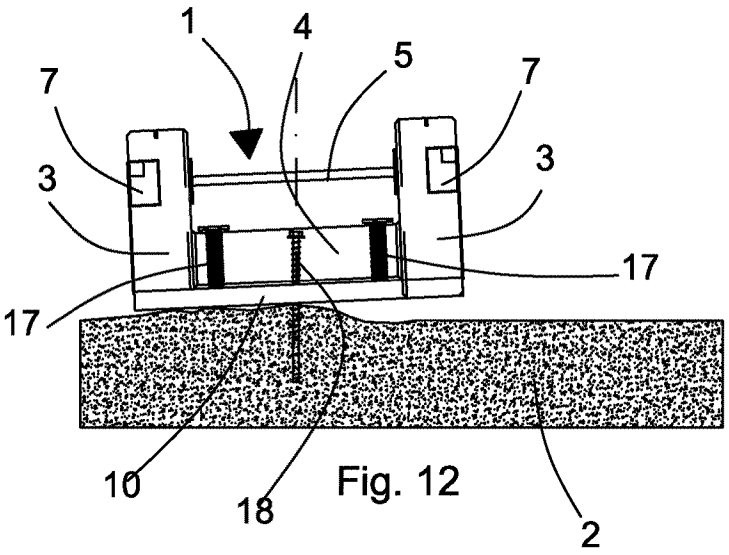
FIGS. 12 to 16 illustrate successive steps of fixing to the raft foundation a ground beam of the fixing system according to the invention.

In a first step, FIG. 12, at least two ground beams 1, previously fixed together as disclosed above, are placed on the foundation 2 of the building, made previously, arranging the ground beams 1 on the basis of references placed on the foundation 2, for example squaring wires, making a first partial fixing of the ground beams 1 by inserting a self-tapping screw 18 for concrete in the still further hole 16 of the connecting element 10, screwing the self-tapping screw 18 partially in the concrete of the foundation 2.

Figure 13:
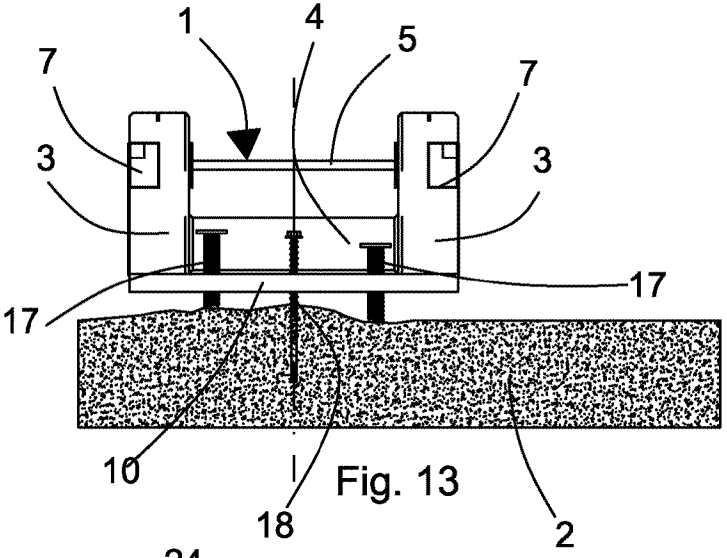

In a second step, FIG. 13, using the adjusting screws 17 a distance of the ground beams 1 with respect to the foundation 2 is adjusted and a tilt thereof, if any, with respect to a horizontal reference plane is corrected using a level. The expression "horizontal plane" means a plane that is perpendicular to the direction of the force of gravity.

Figure 14:
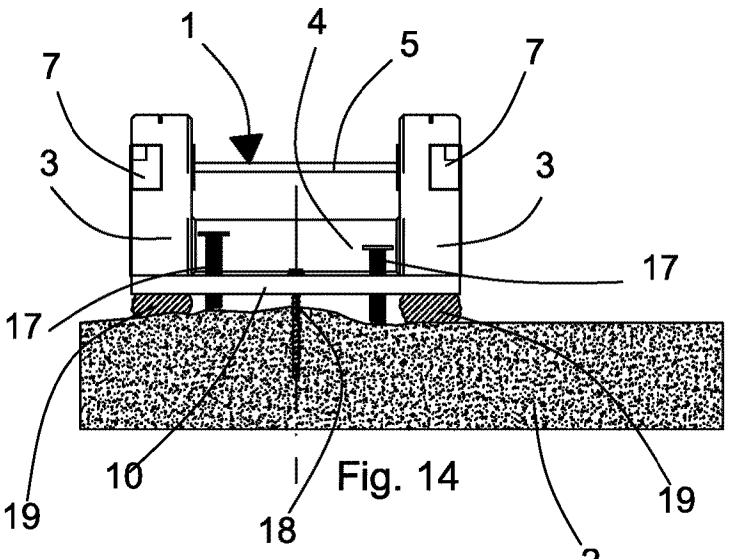

In a third step, FIG. 14, the two ground beams 1 are fixed definitively to the foundation 2 by fully screwing the self-tapping screw 18 into the concrete. Possible spaces that remain between the sides 3 and the foundation 2 are filled with a filling material 19, for example polymer foam.

Figure 15:
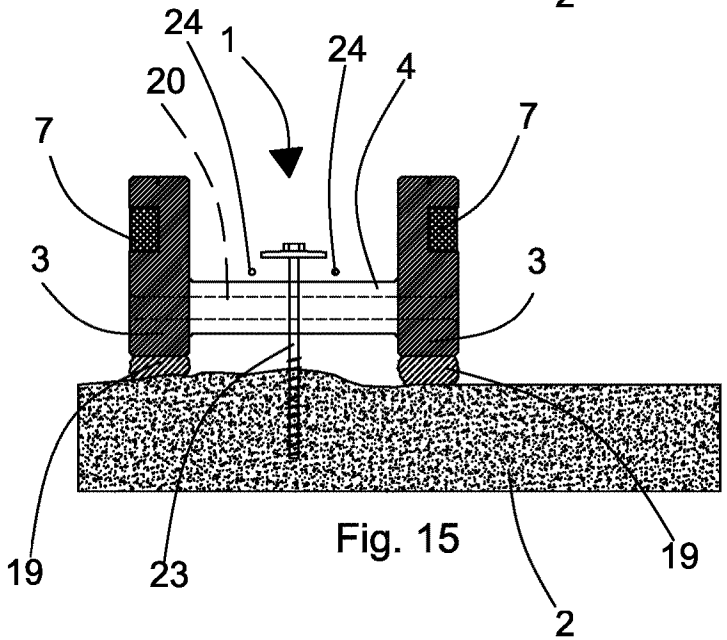

In a fourth step, FIG. 15, possible screw connector elements 23 for concrete are fixed to the foundation 2, the screw connector elements 23 being inserted through the openings 6 in the bottom of the ground beams 1, and reinforcing metal bars 24 for concrete are arranged inside the sides 3, for example being arranged resting on the crosspieces 4.

Figure 16:
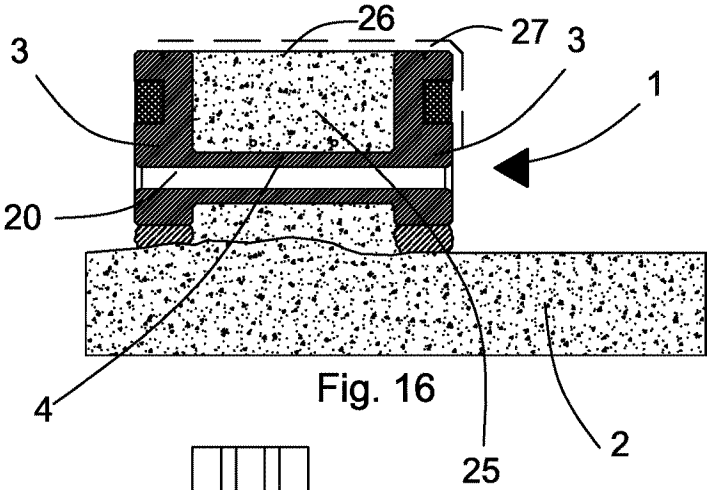

In a fifth step, FIG. 16, a cast of concrete 25 inside the sides 3 of the ground beams 1 is made, for example a cast of concrete reinforced with fibres. The cast of concrete 25 completely fills the space existing between the sides 3, above and below the crosspieces 4, passing through the openings 6 and coming into contact with the concrete of the foundation 2. Further, the cast of concrete 25 envelops the screw connectors 23 and the reinforcing metal bars 24.

The screw connectors 23, previously fixed to the foundation 2, are used to secure the cast of concrete 25 to the foundation 2, whereas the reinforcing metal bars 24 are used to increase the structural resistance of the cast of concrete 24.

The upper surface 26 of the cast of concrete 25 is smoothed so that it is parallel to said horizontal reference plane and does not protrude above the sides 3.

Lastly, a possible transparent sheath 27 is placed on the ground beams 1.

Figure 17:
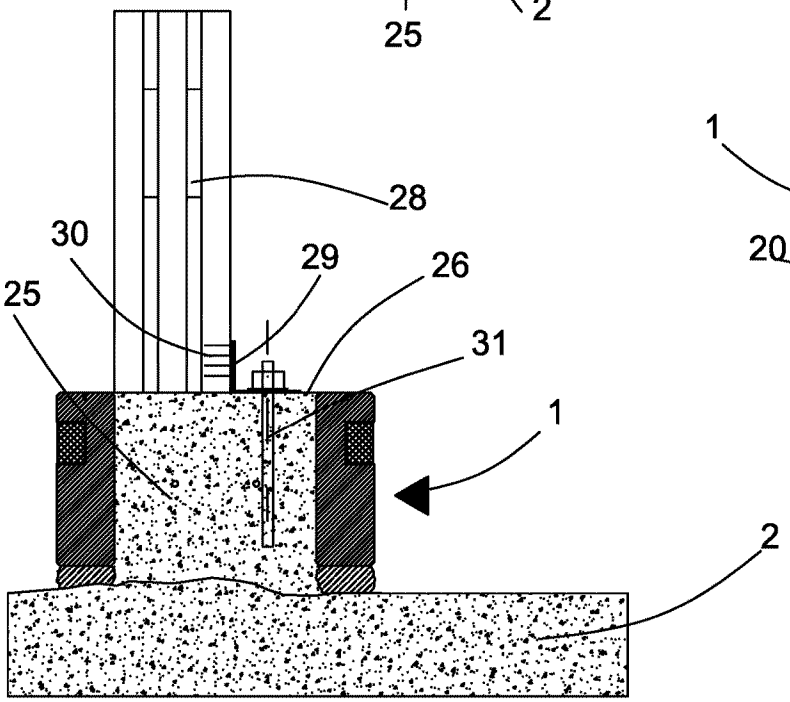
FIG. 17 illustrates the assembly of a wall on a respective ground beam.

In a sixth step, FIG. 17, on the upper surface 26 of the cast 25 of concrete a prefabricated wall 28 is fixed, which is made of material with a low specific weight, for example with wooden panels, fibre plaster or fibre cement panels, or panels consisting of a metal frame filled with thermal and/or acoustic insulating material.

The wall 28 is fixed to the upper surface 26 of the cast of concrete 25 by a plurality of fixing members 29, 30, 31, that comprise, for example, a plurality of L-shaped brackets 29, which are fixed to the wall 28 by further fixing elements 30, consisting, for example, of nails or screws, and to the cast of concrete 25 by still further fixing elements 31, for example concrete screws or expansion plugs.

Alternatively, if the wall 28 is a masonry wall, the wall 28 is made directly on the cast of concrete 25, the masonry wall 28 being fixed to the cast of concrete by mortar.

Figure 18:
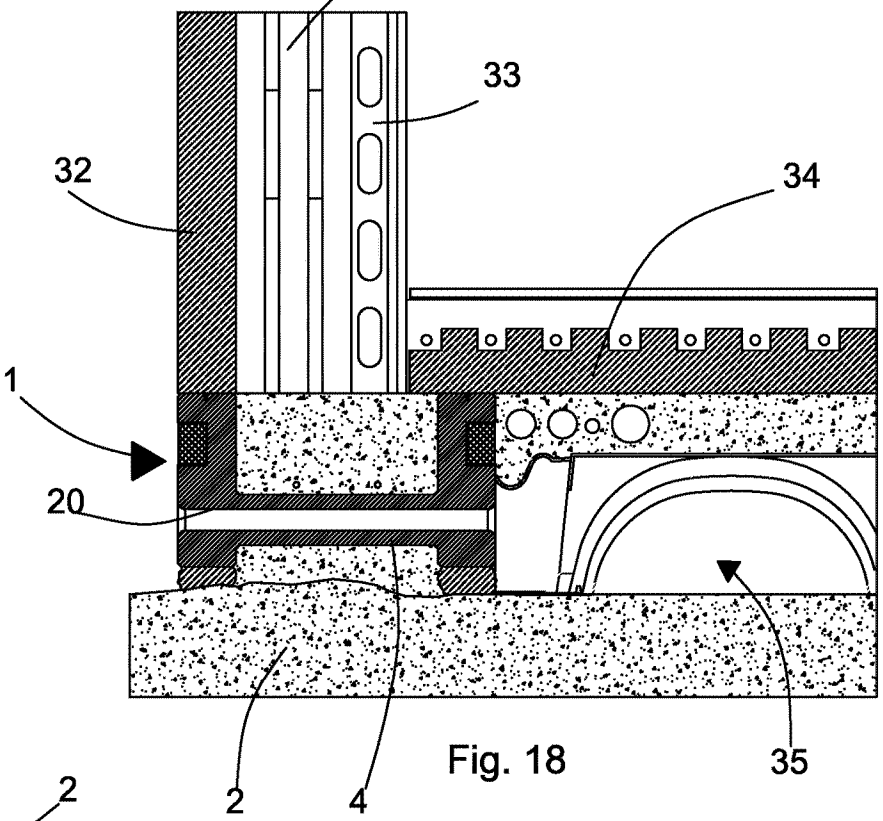
FIG. 18 illustrates achieving the thermal and acoustic insulation of a building that is achievable with the system according to the invention, after the assembly of the walls on the ground beams.

In a sixth step, FIG. 18, an outer surface of the wall 28 is coated with first thermal and/or acoustic insulating arrangement 32, consisting, for example, of panels of thermal insulating material or both thermal and acoustic insulating material, and on the inner surface of the wall 28 second thermal/or acoustic insulating arrangement 33 is placed, which also consists, for example, of panels of thermal insulating material or of thermal and acoustic insulating material.

Subsequently, after the walls 28 of the building have been finished, the subfloors 34 of the building are made, to which will be fixed the floors of the building, and a ventilation space 35 is made, for example an igloo ventilation space, that insulates the blocks 34, and thus the floors of the building, from possible infiltrations of humidity coming from the ground on which the building stands.

The ventilation of the ventilation space 35 is ensured by the ventilation holes 20, made in the crosspieces 4 of the ground beams 1, that communicate at one end with the environment outside the building, and at another end with the ventilation space 35.

The invention claimed is:

1. System for fixing walls of a building to a ground, comprising a plurality of supporting elements interposed between a concrete foundation of the building and said walls, further comprising connecting elements for connecting at least two supporting elements that are aligned with each other, adjusting elements for adjusting a distance of said supporting elements from said foundation and for correcting a possible tilt of said supporting elements with respect to a horizontal reference plane, anchoring elements for anchoring said supporting elements to said foundation, said supporting elements being made of plastics, each of said supporting elements comprising a pair of sides, interconnected by a plurality of crosspieces, wherein through ventilation holes are made in said crosspieces, wherein a lower part of each side has a length in a direction parallel to a longitudinal axis of the supporting element that is less than a length of a rest of the side in the same direction, such that a step is defined between said lower part and the rest of the side, at opposite ends of the side that are perpendicular to said longitudinal axis, wherein said connecting element comprises a body having a height that is substantially the same as a height of said step and a length that is substantially the same as a width of said supporting elements in a direction that is perpendicular to said longitudinal axis, at opposite ends of the body respective uprights being provided that are adapted to be fixed to the sides of two adjacent supporting elements to be connected, said uprights extending perpendicularly to the body.

2. System according to claim 1, wherein between said pairs of sides a plurality of spacer elements is arranged.

3. System according to claim 1, wherein said sides are provided with longitudinal reinforcing elements.

4. System according to claim 1, wherein each of said uprights comprises a first part and a second part that are arranged in a T shape, in said second part fixing holes being made for receiving fixing elements by means of which the connecting element can be fixed to the supporting elements to be connected.

5. System according to claim 4, wherein said second part is provided with an abutting element for positioning correctly the connecting element with respect to the supporting elements to be connected.

6. System according to claim 1, wherein said body is provided with a pair of further holes, arranged in a respective positions that are symmetrical with respect to a vertical central axis of the body, and with a still further hole arranged at the central axis, said further holes being intended for housing said adjusting elements and said still further hole being intended for housing one of said anchoring elements.

7. System according to claim 1, wherein openings are defined on a bottom of each of said supporting elements, wherein said openings are arranged between the sides of each supporting element and the crosspieces, wherein said openings are suitable for enabling a cast of concrete to pass through aid openings to fill completely a space existing between said sides above and below the crosspieces.

8. System according to claim 3, wherein said longitudinal reinforcing elements are made of wood.

* * * * *